US005620117A

United States Patent [19]

Bieze et al.

[11] Patent Number: 5,620,117

[45] Date of Patent: Apr. 15, 1997

[54] EXCHANGEABLE CLOSING AND POURING CAP

[75] Inventors: Jan W. H. Bieze; Gerardus Legue, both of Amsterdam, Netherlands

[73] Assignees: On-Top Products B.V.; Johannes Broersen, both of Wieringerwerf, Netherlands

[21] Appl. No.: 489,681

[22] Filed: Jun. 13, 1995

[30] Foreign Application Priority Data

Jun. 14, 1994 [NL] Netherlands ..... 9400962

[51] Int. Cl.[6] ..... B67D 3/00

[52] U.S. Cl. ..... 222/482; 222/484

[58] Field of Search ..... 222/481, 482, 222/484, 485

[56] References Cited

U.S. PATENT DOCUMENTS

| | | | |
|---|---|---|---|
| 34,899 | 4/1862 | Newton | 222/482 |
| 77,378 | 4/1868 | How | 222/484 X |
| 196,285 | 10/1877 | Banker | 222/484 |
| 207,926 | 9/1878 | Willcox | 222/482 |
| 230,885 | 8/1880 | Mason et al. | 222/482 |
| 285,712 | 9/1883 | Webster | 222/482 |
| 351,875 | 11/1886 | Marsh | 222/482 |
| 364,821 | 6/1887 | Hull | 222/482 |
| 595,222 | 12/1897 | Wakefield | 222/484 |
| 670,136 | 3/1901 | Laudahn | 222/484 |
| 1,949,058 | 2/1934 | Leguillon | 222/529 |
| 2,598,403 | 5/1952 | Macey | 222/484 X |

FOREIGN PATENT DOCUMENTS

0567374A1 4/1993 European Pat. Off. .

*Primary Examiner*—Kevin P. Shaver
*Attorney, Agent, or Firm*—Kinney & Lange, P.A.

[57] ABSTRACT

An exchangeable closing and pouring cap for a container for liquids having an opening for pouring, in particular a soft drink bottle, is provided with suitable connecting threads for placing the cap on the pouring opening, an outlet in the cap for the liquid connection between the container and a pouring lip on the cap, a sealing device which is movable between a closing position and an opening position thereby closing and opening the outlet respectively. The sealing device encloses a plunger element which can be moved to and from in the outlet. The cap is also provided with an air inlet which synchronically with the outlet is also closed and opened respectively.

6 Claims, 1 Drawing Sheet

EXCHANGEABLE CLOSING AND POURING CAP

BACKGROUND OF THE INVENTION

The invention relates to an exchangeable closing and pouring cap for a container for liquids having an opening for pouring, in particular a soft drink bottle, provided with suitable connecting means for placing the cap on the pouring opening, an outlet in the cap for the liquid connection between the container and a pouring lip on the cap and a sealing means which is movable between a closing position and an opening position thereby closing and opening the outlet respectively.

Such a cap is known, for instance, from the European patent application 0 567 374. The cap disclosed therein is in particular meant for bottles or tubes containing, for instance, cosmetics or maintenance products. The construction of the cap is quite intricate and is also unsuitable for pouring soft drinks fast.

It is especially in the area of soft drink bottles that a good cap is much needed. Particularly in catering establishments precious time is wasted by every time having to unscrew and after pouring having to screw on the standard screw cap in the case where larger soft drink bottles are being used. Moreover, with carbonated soft drinks the well known problem exists of the carbon dioxide disappearing quickly if the bottle is not closed properly, or remains open too long during pouring. Also, the content of soft drink bottles becomes ever larger nowadays, making it ever more important that the bottle can be closed well and that the bottle remains open for as short a time as possible.

It is now the objective of the invention to provide an exchangeable closing and pouring cap, whereby the above-mentioned problems are removed effectively.

SUMMARY OF THE INVENTION

To this effect the cap of the invention is characterized in that the sealing means possesses a plunger element which can be moved to and fro in the outlet, while the cap is also provided with an air inlet which, synchronically with the outlet, is also closed and opened respectively by means of the plunger element.

The plunger element serving as closing means provides a reliable seal while it may have a simple construction and is easy to use. The air inlet which together with the pouring lip is closed and opened simultaneously by means of the plunger element, allows for fast pouring of the contents of the container, such as soft drink whereby, in combination with the quick operation of the plunger element, little time is lost during pouring and also the length of time that the bottle is open is minimized, losing as little as possible carbon dioxide.

It is advantageous if the plunger element, when affixed, extends in the longitudinal direction of the cap in line with the pouring opening of the container. In this way the plunger element is operated most easily, especially when the plunger element protrudes from the cap away from the container and is provided with a control knob.

The pouring lip can extend in the main transversely on the cap, whereby it would be advantageous if the air inlet is situated more or less diametrically opposite the pouring lip. This arrangement makes it possible that the air inlet is at the same time the pouring lip. This allows pouring from two sides, whereby the pouring lip not used for pouring serves as air inlet.

Sealing by means of the plunger element can on the one hand be effectuated in the cap itself, whereby naturally a good seal between the cap and the container must be guaranteed, and on the other hand it is possible, in the closed state, to have the plunger element protrude into the pouring opening of the container, so that sealing takes place directly in the container. In the latter case the pouring opening of the container will have to be able to accomodate small dimensional tolerances, and the sealing part of the plunger element must be able to compensate possible tolerances.

BRIEF DESCRIPTION OF THE DRAWINGS

The invention will be further elucidated with the aid of the drawing, wherein examples of embodiments of the invention are given schematically.

DETAILED DESCRIPTION OF THE PREFERRED EMBODIMENT

Figure 1:
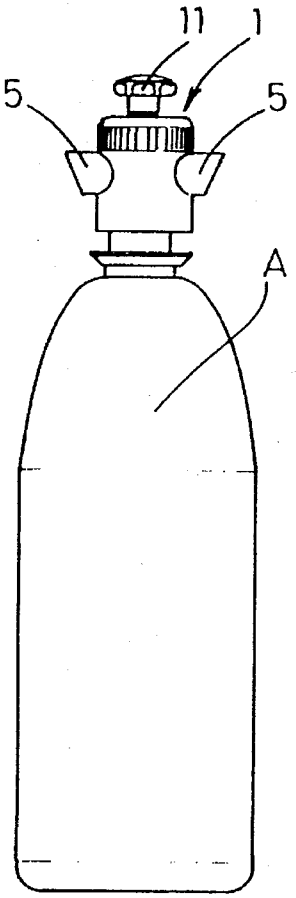
FIG 1 is a schematic, perspective view of a soft drink bottle with on it an embodiment example of the exchangeable closing and pouring cap according to the invention.

The drawing, and in particular FIG. 1 shows a soft drink bottle A, for which the invention is in particular, but not exclusively, intended. The invention can also be used on bottles for other liquid products or on other types of containers. Reference number 1 indicates the closing and pouring cap according to the invention in its entirety.

Figure 2:
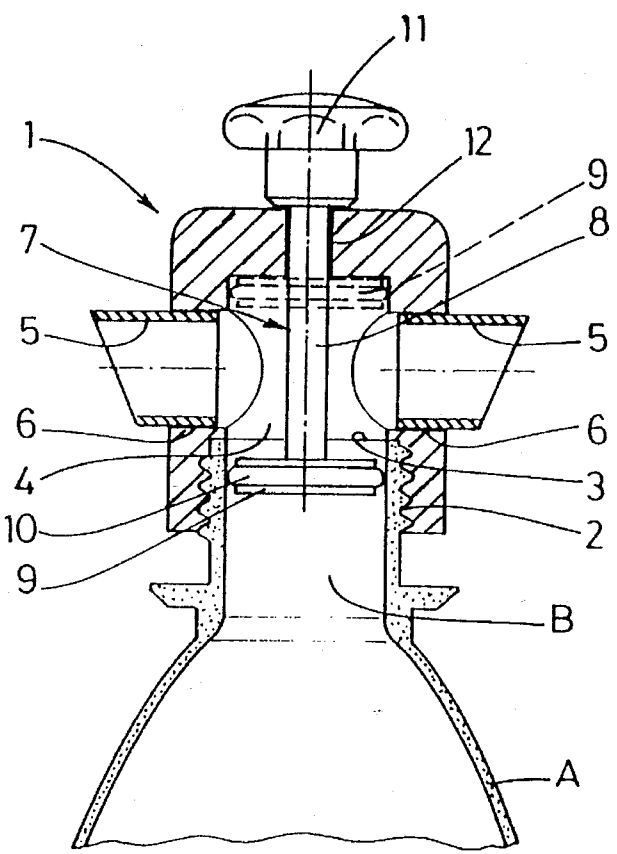
FIG. 2 shows on a larger scale a vertical cross-section of the cap and a part of the bottle of FIG. 1.

FIG. 2 shows the cap 1 in more detail. One can see that the cap at the underside is provided with screw thread 2 fitting the screw thread around the pouring opening B in the neck of the bottle A. Depending on the bottle A or other container, the screw thread 2 may naturally be replaced by other suitable connecting means, such as a bayonet fitting or the like. In the case as shown, the cap 1 connects with a seating 3 and seals onto the top rim of the bottle A. The cap is further provided with an outlet 4 lined up with the pouring opening B of the bottle A, connecting in this case with two diametrically opposite pouring lips 5. These pouring lips 5 may be formed from separate tube pieces which are fixed in bore holes 6 in the lateral wall of the cap 1, but, of course, the pouring lips 5 may also be formed integrally with the wall of the cap 1. The shape of the pouring lips 5 may be chosen such that pouring is facilitated. In this case one pouring lip must always actually serve as pouring lip 5 and the opposite pouring lip 5 serves as air inlet to let air into the bottle, making faster and more even pouring possible.

Closing and opening of the outlet 4 to the pouring lip 5 or the air inlet respectively is effectuated with the aid of a plunger element 7 serving as closing means, consisting in this case of a stem 8 whereby its end directed at the bottle A is provided with a disc 9 with in a groove around its periphery an O-ring or similar sealing means, and at the opposite end with a control knob 11. This control knob 11 is located outside the cap 1 and to that end the stem 8 of the plunger element 7 is led, via a passage 12 in the top of the cap in sealed condition, to the outside. By means of the control knob 11 the plunger element 7 can be moved between a closed position, represented by full lines and an open position, represented by a broken line, whereby the outlet 4 is released to the pouring lip or air inlet 5 respectively. In this embodiment sealing takes place directly in the pouring opening B of the bottle A while the plunger element 7 is in the closed position, and the disc 9 with the O-ring 10 protrudes sufficiently from the outlet 4, as shown in FIG. 2.

Figure 3:
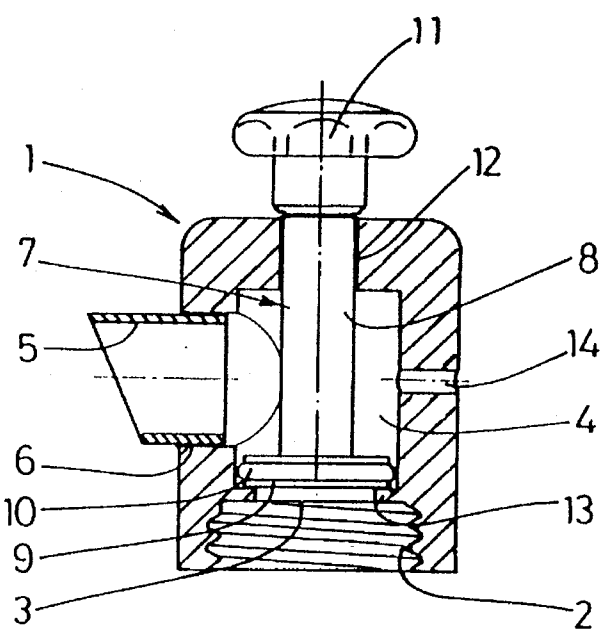
FIG. 3 shows a vertical cross-section of an alternative embodiment of the exchangeable closing and pouring cap according to the invention.

FIG. 3 shows an alternative for the embodiment of FIG. 2, whereby sealing is effectuated by the plunger element 7 being in the closing position in the outlet 4 of the cap 1 itself. The closing position of the plunger element 7 is determined by a stop or seating 13. In this embodiment the air inlet is a smaller hole 14 in the lateral wall of the cap 1. This hole 14 only serves as air inlet and not at the same time as pouring lip. Apart from that this embodiment of the cap 1 is comparable to the one in FIG. 2.

It will be clear from the above that the invention provides a simply constructed and easily usable cap, allowing for fast pouring and at the same time providing a reliable seal.

The invention is not limited to the embodiments as shown in the drawing and as described above, which may be varied in different ways within the scope of the invention. It would also be possible to fit the pouring lip in line with the pouring opening of the container and to have the plunger element extending more or less vertically thereto. It is further possible to provide facilities to hold the plunger element tightly in the closing position. These can, for instance, be activated by a turning movement of the control knob.

What is claimed is:

1. A closing and pouring cap for use with a bottle having an opening for pouring liquids, the closing and pouring cap comprising:

connecting means for fixedly securing the cap on the pouring opening of a bottle;

an air inlet and an outlet in the cap configured to provide fluid communication between an interior of the bottle and a pouring lip on the cap; and a plunger movable between a closed position and an opened position, thereby respectively closing and opening the air inlet and the outlet, wherein the outlet and the plunger are configured such that the plunger, in the closed position, protrudes into the pouring opening of a bottle for sealing the bottle, and wherein the plunger comprises a longitudinal stem having a disc provided with a peripheral sealing ring at its end, the disc and sealing ring movable within the cap, the end of the stem opposite from the disc protruding from a top portion of the cap and having a control knob.

2. The cap of claim 1, wherein the longitudinal axis of the cap aligns with a longitudinal axis of a pouring opening of a bottle when the cap is mounted on a bottle.

3. The cap of claim 1, wherein the pouring lip extends essentially transversely to the longitudinal axis of cap.

4. The cap of to claim 3, wherein the air inlet is positioned essentially diametrically opposite the pouring lip.

5. The cap of claim 4, wherein the air inlet is shaped as a pouring lip.

6. The cap of claim 1, further comprising a seating in the outlet against which the plunger rests when in the closed position.

* * * * *